United States Patent [19]

Huenniger

[11] Patent Number: 4,502,530

[45] Date of Patent: Mar. 5, 1985

[54] WATERBOX FOR A SHELL AND TUBE HEAT EXCHANGER

[75] Inventor: Edward A. Huenniger, Liverpool, N.Y.

[73] Assignee: Carrier Corporation, Syracuse, N.Y.

[21] Appl. No.: 421,745

[22] Filed: Sep. 23, 1982

[51] Int. Cl.[3] ..... F28F 9/06

[52] U.S. Cl. ..... 165/72; 165/75; 165/158; 165/176

[58] Field of Search ..... 165/158, 175, 176, 173, 165/159, 179, 76, 75, 72

[56] References Cited

U.S. PATENT DOCUMENTS

| | | | |
|---|---|---|---|
| 1,789,880 | 1/1931 | Price | 165/158 |
| 1,862,310 | 6/1932 | How | 165/158 |
| 2,259,604 | 10/1941 | Banks | 165/158 |
| 2,340,397 | 2/1944 | McNeal | 165/158 |
| 3,393,731 | 7/1968 | Friedman et al. | 165/158 |
| 3,792,729 | 2/1974 | Perry | 165/176 |

*Primary Examiner*—Albert W. Davis, Jr.

*Attorney, Agent, or Firm*—David J. Zobkiw

[57] ABSTRACT

A waterbox for a shell and tube heat exchanger is disclosed. The waterbox is attached at one end of the heat exchanger to a tube sheet through which heat exchange tubes extend. Nozzle connections are made to the waterbox through a top member having an access opening which projects onto an area of the tube sheet through which the heat exchange tubes extend. The openings of the nozzles project onto areas on the tube sheet through which no heat exchange tubes extend. A removable cover is positioned over the access opening in the top member so that, when fluid flow conduits are connected to the nozzles on the top member, the conduits and removable cover are positioned relative to each other to allow removal of the cover without disturbing the connections between the conduits and the nozzles. In an alternative embodiment, the conduit connections are made through the back wall of the tube sheet rather than through the top member. This allows use of a waterbox with a removable top member having no nozzles.

4 Claims, 4 Drawing Figures

WATERBOX FOR A SHELL AND TUBE HEAT EXCHANGER

BACKGROUND OF THE INVENTION

The present invention relates to shell and tube heat exchangers for refrigeration systems and more particularly relates to waterboxes for such shell and tube heat exchangers.

Many refrigeration systems have shell and tube heat exchangers wherein the tubes extend through tube sheets which form the ends of the shell, and wherein tube support sheets are used in the shell to further support the tubes. Usually, water is passed through the tubes which are in thermal contact with a refrigerant flowing through the shell side of the heat exchanger. Normally, a waterbox is attached to a tube sheet at one end of the heat exchanger to enclose the ends of the tubes extending through the tube sheet and to supply and direct the flow of water through the tubes of the heat exchanger. Another box is attached to the tube sheet at the other end of the heat exchanger to enclose the ends of the tubes extending through this tube sheet to provide a complete fluid flow circuit through the heat exchanger. Typically, there is at least one partition in the water supply waterbox dividing this waterbox into a first section having a first group of heat exchanger tubes and a second section having a second group of heat exchanger tubes. Water is supplied to the waterbox through a water supply conduit connected to a nozzle on the waterbox which forms a fluid flow circuit with the first group of tubes in the first section of the waterbox. The water supplied to the waterbox flows through the first group of tubes to the opposite end of the heat exchanger and is returned through the second group of tubes to the second section of the waterbox. A water return conduit is connected to a nozzle on the waterbox which forms a fluid flow circuit with the second group of tubes in the second section of the waterbox and the water is directed out of the waterbox through this return conduit. If desired, more than two passes of the water through the heat exchanger may be obtained by using more partitions dividing the tubes into several distinct, interconnected groups.

To clean or inspect the tubes in the heat exchanger, or for other such purposes, it is necessary to gain access to the interiors of the tubes. Conventionally, in order to provide access to the interiors of the heat exchanger tubes, the nozzle connections to the waterbox are made through a side wall of the waterbox, which is normally a curved shape, so that an end cover of the waterbox may be removed thereby exposing the ends of the tubes. The nozzle connections are made through the side wall so that access to the heat exchanger tubes is obtained without having to disturb the nozzle connections to the waterbox. This type of waterbox is known as a marine waterbox. However, marine waterboxes are relatively difficult and costly to manufacture because of the inherent complexity in making nozzle connections through a curved side wall and because of the necessity to provide relatively large side walls to accommodate the nozzle connections.

A simpler and less costly waterbox is provided by making the nozzle connections to the waterbox through the end cover of the waterbox because the end cover is usually flat. However, the water supply and return conduits must be disconnected from the waterbox nozzles before the cover can be removed to gain access to the interiors of the heat exchanger tubes. This is undesirable because it is usually difficult and cumbersome to disconnect the conduits.

SUMMARY OF THE INVENTION

Therefore, it is an object of the present invention to provide a relatively simple and relatively inexpensive waterbox for a shell and tube heat exchanger wherein access to the interiors of the heat exchanger tubes may be obtained without disturbing nozzle connections to the waterbox.

This and other objects of the present invention are attained by a waterbox comprising a wall member, a top member, a partition, and a removable cover. The wall member is attached to a tube sheet at one end of the heat exchanger to surround a selected area on the tube sheet which includes the area through which the heat exchange tubes extend. The top member is attached to the wall member to form an enclosure at the end of the heat exchanger. The top member has a first nozzle whose opening projects onto an area of the tube sheet through which no heat exchange tubes extend and a second nozzle whose opening projects onto a different area on the tube sheet through which no heat exchange tubes extend. In addition, the top member has an access opening which projects onto the area of the tube sheet through which the heat exchange tubes extend. The partition is within the enclosure formed by the top member and the wall member and divides the heat exchange tubes into a first group which forms a first fluid flow circuit with the first nozzle and a second group which forms a second fluid flow circuit with the second nozzle. The removable cover is located over the access opening in the top member. Fluid flow conduits may be attached to the nozzles of the top member so that the conduits and removable cover are positioned relative to each other so that the cover may be removed without disturbing the connections between the fluid flow conduits and the nozzles.

An alternate way of connecting the fluid flow conduits to the waterbox is to connect them through the shell of the heat exchanger and the back wall of the tube sheet into the waterbox on the front wall of the tube sheet. With this arrangement, a waterbox comprising a removable integral housing may be attached to the front wall of the tube sheet to enclose the area on the tube sheet through which the fluid flow conduits and the heat exchange tubes extend. The entire housing or a cover covering an opening in the housing may be removed, to gain access to the interiors of the heat exchanger tubes, without disturbing the conduit connections to the waterbox since the conduit connections are made through the back wall of the tube sheet. If desired, to avoid cutting through the shell of the heat exchanger, the tube sheet may be constructed to extend beyond the boundary of contact between the back wall of the tube sheet and the heat exchanger shell, and the fluid flow conduits may be connected through this extended area of the tube sheet into the waterbox.

BRIEF DESCRIPTION OF THE DRAWINGS

Other objects and advantages of the present invention will be apparent from the following detailed description in conjunction with the accompanying drawings, wherein like reference numerals identify like elements, and in which.

DESCRIPTION OF THE PREFERRED EMBODIMENT

Figure 1:
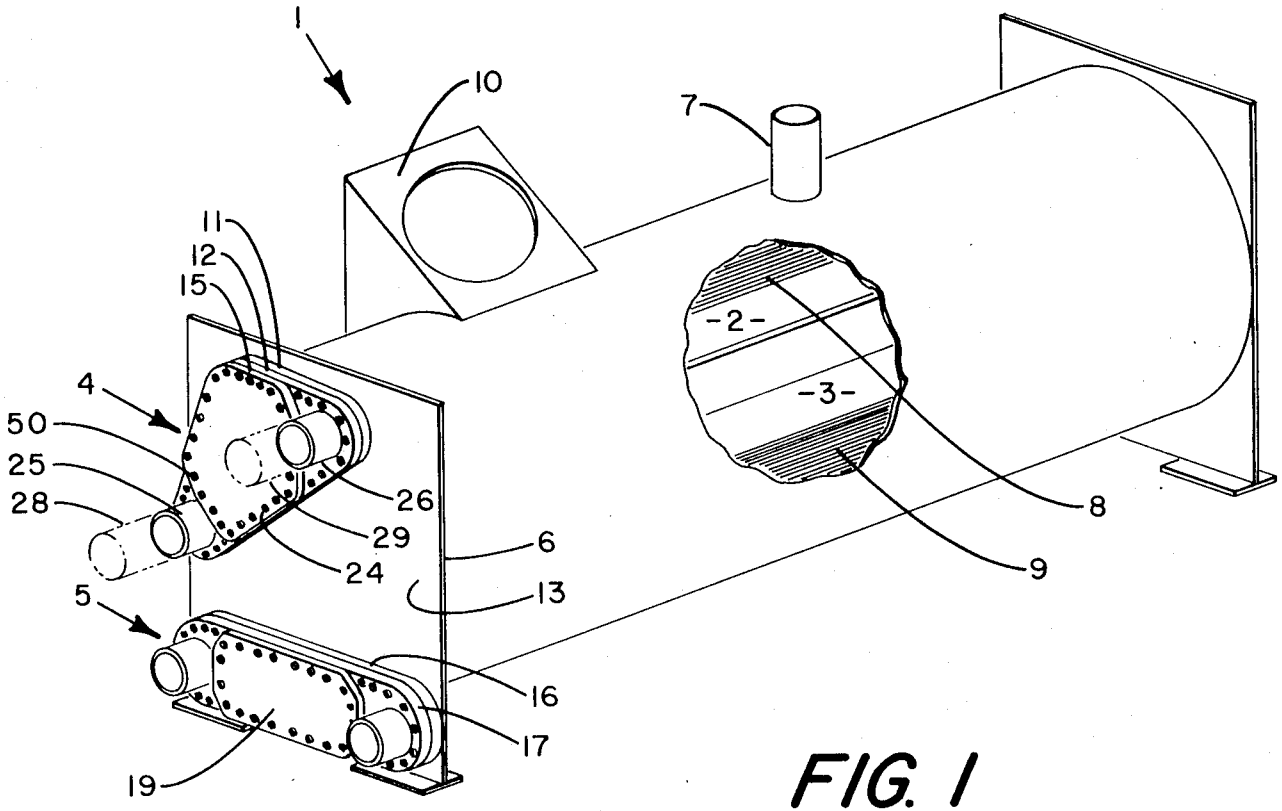
FIG. 1 is a perspective view of a shell and tube heat exchanger having a condenser waterbox and an evaporator waterbox, each according to the principles of the present invention.

Referring to FIG. 1, a perspective view is shown of a shell and tube heat exchanger 1 having a condenser section 2 and an evaporator section 3. A condenser waterbox 4 and an evaporator waterbox 5 are located on a tube sheet 6 at one end of the heat exchanger 1. The heat exchanger 1 is part of a refrigeration system in which gaseous refrigerant is compressed by a compressor (not shown) and supplied through a first shell nozzle 7 to the condenser section 2 of the heat exchanger 1. The gaseous refrigerant is condensed in the condenser section 2 due to flow of a heat exchange medium, such as cool water, through tubes 8 in the condenser section 2. Liquid refrigerant from the condenser section 2 is supplied through a valve (not shown) to the evaporator section 3 wherein the liquid refrigerant is flashed to cool a heat exchange medium, such as water, flowing through tubes 9 in the evaporator section 3. The gaseous refrigerant from the evaporator section 3 is supplied through a second shell nozzle 10 back to the compressor to repeat the refrigeration cycle just described.

Figure 2:
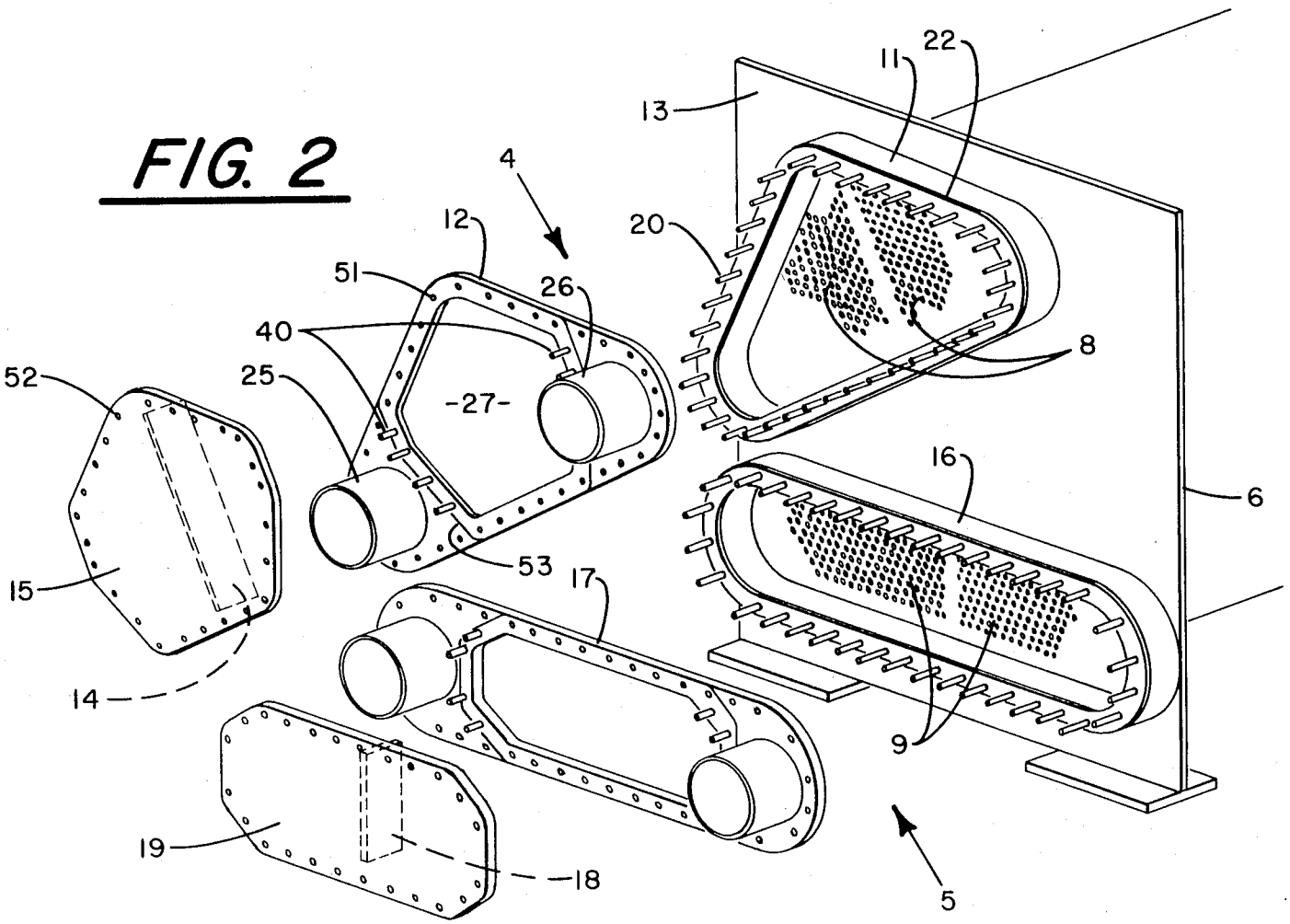
FIG. 2 is an exploded view of the waterboxes shown in FIG. 1.

Referring to FIG. 2, an exploded view is shown of the condenser waterbox 4 and the evaporator waterbox 5 shown in FIG. 1. As shown in FIG. 2, the condenser waterbox 4 comprises a wall member 11, a top member 12, a partition 14, and a removable cover 15. Also, as shown in FIG. 2, the evaporator waterbox 5 is equivalent to the condenser waterbox 4. That is, the evaporator waterbox 5 comprises a wall member 16, a top member 17, a partition 18, and a cover 19 assembled in the same manner as will be described with respect to the corresponding components of the condenser waterbox 4.

As shown by FIGS. 1 and 2, the wall member 11 of the condenser waterbox 4 is positioned on the front surface 13 of the tube sheet 6 to surround a selected area including the area of the tube sheet 6 through which the condenser heat exchange tubes 8 extend. The top member 12 is attached to the wall member 11 to form an enclosure at the end of the heat exchanger 1 having an access opening 27 therein. The access opening 27 is covered by the removable cover 15 which may be removed to gain access to the interiors of the condenser heat exchange tubes 8. The wall member 11, and top member 12 are attached to the tube sheet 6 by weld studs 20 and nuts 24. Also, weld studs 40 on the top member 12 are used with nuts 50 to attach the removable cover 15 to the top member 12.

The studs 20 are welded to, and extend from the tube sheet 6. A gasket (not shown) is positioned about the studs 20 next to the tube sheet 6. The wall member 11 has holes for accommodating each of the studs 20. By positioning the wall member 11 on the studs 20, a fluid tight seal is provided by the gasket around the studs 20 between the tube sheet 6 and the wall member 11.

The wall member 11 is positioned on the studs 20 so that the ends of studs 20 extend through the holes in the wall member 11. A gasket 22 is provided around these ends of the studs 20. The top member 12 has holes 51 for accommodating the ends of studs 20 which extend through the wall member 11. The top member 12 is positioned over the studs 20 with the gasket 22 between the top member 12 and the wall member 11 to provide a fluid tight seal at this joint.

The removable cover 15 has holes 52 for accommodating the tips of the studs 20 which extend through the top member 12 and for accommodating the studs 40 which extend from the top member 12. A gasket 53 is located on the top member 12 around the studs 20 and 40 so that when the removable cover 15 is positioned next to the top member 12 a fluid tight seal is formed at this joint.

As shown in FIG. 1, nuts 24 and nuts 50 are screwed on the studs 20 and the studs 40, respectively, to hold the wall member 11, the top member 12, and the cover 15 in position. The cover 15 may be removed simply by unscrewing the nuts holding the cover 15 in place and by removing the cover 15 from the bolts.

Of course, the foregoing is only one way of attaching the wall member 11, the top member 12, and the cover 15 to form the condenser waterbox 4 on the tube sheet 6. For example, if desired, the wall member 11 may be a bolting flange which is welded directly to the tube sheet 6 with the flanged portion extending out from the tube sheet 6. Then, the top member 12 and the cover 15 may be bolted with cap screws directly to the flanged portion of the wall member 11. Also, it should be noted that many other forms of attachment will be readily apparent to one of ordinary skill in the art.

As shown by FIGS. 1 and 2, the top member 12 has a first nozzle 25, and a second nozzle 26, in addition to the access opening 27. The first nozzle 25 has an opening which projects onto an area of the tube sheet 6 through which no heat exchange tubes 8 extend. That is, an orthographic projection of the opening of nozzle 25 onto the front planar surface 13 of the tube sheet 6 does not project onto an area of the tube sheet 6 through which condenser heat exchange tubes 8 extend. Similarly, the second nozzle 26 has an opening which projects onto a different area of the tube sheet 6 through which no condenser heat exchange tubes 8 extend. However, the access opening 27 does project onto the area of the tube sheet 6 through which the condenser heat exchange tubes 8 extend.

The partition 14 is located within the enclosure formed by the wall member 11, the top member 12, and the cover 15, and divides condenser heat exchange tubes 8 into a first group which forms a first fluid flow circuit with the first nozzle 25 and a second group which forms a second fluid flow circuit with the second nozzle 26. When in position the partition 14 forms a fluid tight divider between the two groups of condenser heat exchange tubes. As shown in FIG. 2, in order to simplify the drawing, the partition 14 is shown in phantom lines behind the cover 15. Also, only one partition 14 is shown for purposes of simplifying the description of the present invention, and it is to be understood that, if desired, several partitions 14 may be within the enclosure to divide the condenser heat exchanger tubes 8 into several interconnected flow paths.

The removable cover 15 is bolted, as described previously, or otherwise suitably attached to the top member 12 to cover the access opening 27 in the top member 12. As shown by FIGS. 1 and 2, the cover 15 may be removed by simply unscrewing the nuts 24 and 50 from the bolts 20 and 40 holding the cover 15 in place and by pulling the cover 15 off the bolts 20 and 40.

Also, as shown in FIG. 1, a water supply conduit 28 is connected to the first nozzle 25 of the top member 12 and a water return conduit 29 is connected to the second nozzle 26 of the top member 12. The nozzle connections and the removable cover 15 are positioned relative to each other so that the cover 15 may be removed without disturbing the connections between the water supply conduit 28 and the first nozzle 25 and between the water return conduit 29 and the second nozzle 26.

Figure 3:
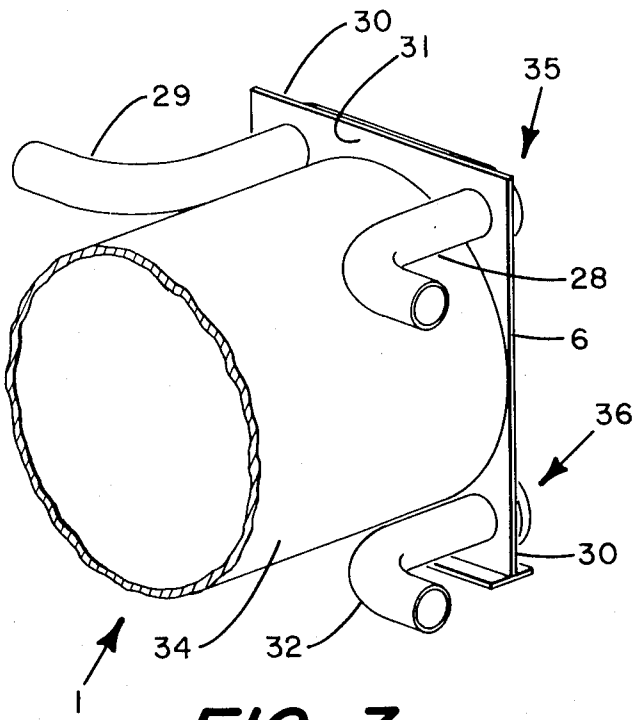
FIG. 3 is a perspective view of part of a shell and tube heat exchanger having a condenser waterbox and an evaporator waterbox, according to the principles of the present invention, wherein fluid flow conduits are connected through a back wall of the tube sheet which forms the end of the heat exchanger to which the waterboxes are attached.

Referring to FIG. 3, an alternative way of connecting the water supply conduit 28 and the water return conduit 29 to a condenser waterbox 35 is shown. As shown in FIG. 3, the shell and tube heat exchanger 1 has a tube sheet 6 with a portion 30 which extends beyond the border of contact between back wall 31 of the tube sheet 6 and shell 34 of the heat exchanger 1. The condenser water supply conduit 28 and the condenser water return conduit 29 are connected through the back wall 31 into the condenser waterbox 35 which is attached to the front wall of the tube sheet 6. Also, as shown by FIGS. 3 and 4, an evaporator water supply conduit 32 and an evaporator water return conduit 33 are connected through the back wall 31 of the extended portion 30 of the tube sheet 6 into an evaporator waterbox 36 which is attached to the front wall of the tube sheet 6.

It should be noted that the foregoing is only one way of connecting the fluid flow conduits 28, 29, 32, and 33, through the back wall 31 of the extended portion 30 of the tube sheet 6. Other types of connections will be readily apparent to one of ordinary skill in the art. For example, in order to avoid the necessity of providing the extended portion 30 of the tube sheet 6, the fluid flow conduits 28, 29, 32, and 33, may be routed first through the shell 34 of the heat exchanger 1 and then through the back wall 31 of the tube sheet 6. However, this arrangement requires cutting holes in the shell 34 to accommodate the fluid flow conduits 28, 29, 32, and 33.

Figure 4:
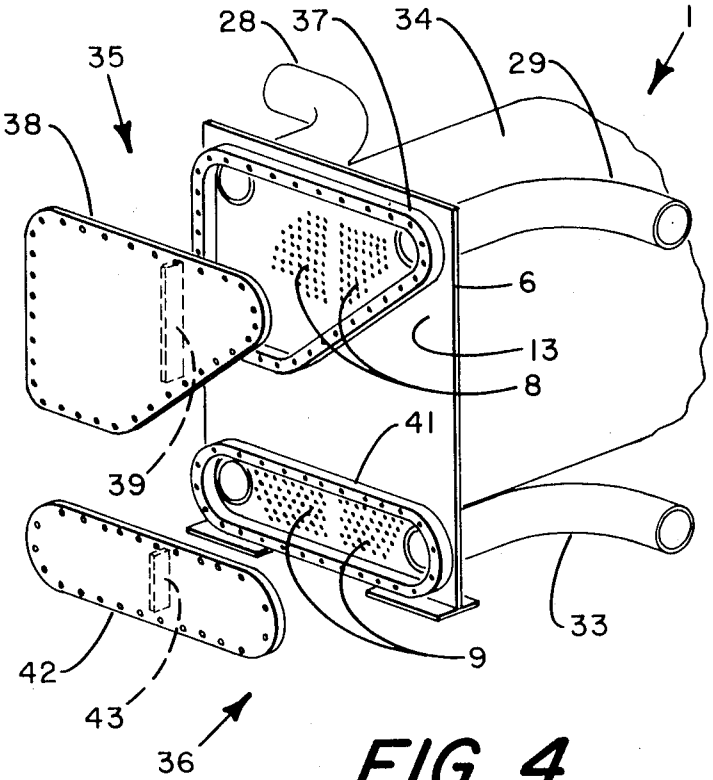
FIG. 4 is an exploded view of the waterboxes shown in FIG. 3.

Referring to FIG. 4, an exploded view is shown of the condenser waterbox 35 and the evaporator waterbox 36 which are attached to the front wall 13 of the tube sheet 6 of the heat exchanger 1. The condenser waterbox 35 comprises a wall member 37, a top member (removable cover) 38, and a partition 39. The evaporator waterbox 36 is equivalent to the condenser waterbox 35. That is, the evaporator waterbox 36 comprises a wall member 41, a top member (removable cover) 42, and a partition 43 assembled in the same manner as will be described with respect to the corresponding components of the condenser waterbox 35.

The wall member 37 of the condenser waterbox 35 may be welded or bolted onto the front surface 13 of the tube sheet 6 in a manner similar to that as described with respect to the wall member 11 shown in FIG. 2. The wall member 37 is positioned on the tube sheet 6 to surround the area through which the fluid flow conduits 28 and 29, and the condenser heat exchange tubes 8, extend. The top member 38 is attached to the wall member 11 to form a fluid tight enclosure on the tube sheet 6 at the end of the heat exchanger 1. As discussed previously with respect to FIGS. 1 and 2, any suitable attachment means may be used to form this enclosure. Also, it should be noted that although the fluid tight enclosure shown in FIG. 4 is comprised of a wall member 37 and a top member 38, if desired, the enclosure may be a one piece housing. This housing would be attached to the tube sheet 6 in any suitable manner so that, when desired, the housing may be removed from the tube sheet 6 to gain access to the interiors of the condenser heat exchange tubes 8.

As shown in FIG. 4, the top member 38 has no nozzles or access opening. These elements are not necessary since the fluid flow conduits 28 and 29, are connected through the back wall 31 of the tube sheet 6. To gain access to the interiors of the condenser heat exchange tubes 8 it is only necessary to unbolt and remove the top member 38.

Also, it should be noted that the partition 39 is located within the condenser waterbox 35 to divide the condenser heat exchange tubes 8 into a first group which forms a first fluid flow circuit with the water supply conduit 28 and a second group which forms a second fluid flow circuit with the water return conduit 29. The partition 39 is positioned to form a fluid tight divider within the waterbox 35 in the same manner as described with respect to the partition 14 shown in FIG. 2. Also, as done with respect to the partition 14 shown in FIG. 2, the partition 39 is shown in phantom lines and only one partition 39 is shown to simplify the drawing of the present invention. It is be understood that, if desired, several partitions 39 may be within the condenser waterbox 35 to divide the condenser heat exchanger tubes 8 into several interconnected flow paths.

Finally, while the present invention has been described in conjunction with particular embodiments it is to be understood that various modifications and other embodiments of the present invention may be made without departing from the scope of the invention as described herein and as claimed in the appended claims.

What is claimed is:

1. A waterbox for a shell and tube heat exchanger having a tube sheet at one end of the heat exchanger for supporting heat exchange tubes which extend through the tube sheet, said waterbox comprising:

a wall member attached to the tube sheet to surround a selected area on the tube sheet which includes the area through which the heat exchange tubes extend;

a top member attached to the wall member to form an enclosure at the end of the heat exchanger, said top member having an access opening which projects onto the area on the tube sheet through which the heat exchange tubes extend;

a nozzle means located in the top member for forming an opening in the top member which projects onto an area on the tube sheet through which no heat exchange tubes extend; and a removable cover over the access opening in the top member.

2. A waterbox for a shell and tube heat exchanger as recited in claim 1, further comprising:

a conduit means, connected to said nozzle means, for forming a fluid flow circuit with the heat exchange tubes, said conduit means and removable cover positioned relative to each other to allow removal of said cover without disturbing the connection between said conduit means and said nozzle means.

3. A waterbox for a shell and tube heat exchanger having a tube sheet at one end of the heat exchanger for supporting heat exchange tubes which extend through the tube sheet, said waterbox comprising:

a wall member attached to the tube sheet to surround a selected area on the tube sheet which includes the area through which the heat exchange tubes extend;

a top member attached to the wall member to form an enclosure at the end of the heat exchanger, said top member having a first nozzle whose opening projects onto an area on the tube sheet through which no heat exchange tubes extend, a second nozzle whose opening projects onto a different area on the tube sheet through which no heat exchange tubes extend, and an access opening which projects onto the area on the tube sheet through which the heat exchange tubes extend;

a partition means within the enclosure formed by the top member and the wall member, for dividing the heat exchange tubes into a first group which forms a first fluid flow circuit with the first nozzle and a second group which forms a second fluid flow circuit with the second nozzle; and a removable cover over the access opening in the top member.

4. A waterbox for a shell and tube heat exchanger as recited in claim 3, further comprising:

a first conduit connected to the first nozzle; and a second conduit connected to the second nozzle, said first conduit, second conduit, and removable cover positioned relative to each other to allow removal of said cover without disturbing the connections between the first conduit and first nozzle and between the second conduit and second nozzle.

* * * * *